US006412486B1

(12) United States Patent
Glass

(10) Patent No.: US 6,412,486 B1
(45) **Date of Patent: *Jul. 2, 2002**

(54) DISPOSABLE FILTERING FACE MASK AND METHOD OF MAKING SAME

(76) Inventor: Leonard W. Glass, P.O. Box 423, Rancho Santa Fe, CA (US) 92067

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/350,209

(22) Filed: Jul. 9, 1999

(51) Int. Cl.[7] ..... A62B 18/02; A62B 23/02; A62B 7/10

(52) U.S. Cl. ..... 128/206.19; 128/205.27; 128/205.29; 128/206.12

(58) Field of Search ..... 128/205.27, 205.29, 128/206.12, 206.13, 206.19; D24/110.1

(56) References Cited

U.S. PATENT DOCUMENTS

| | | | | | |
|---|---|---|---|---|---|
| 3,315,674 | A | | 4/1967 | Bloom et al. | |
| 3,747,599 | A | | 7/1973 | Malmin | |
| 3,884,227 | A | * | 5/1975 | Lutz et al. | 128/206.13 |
| 4,141,703 | A | | 2/1979 | Mulchi | |
| 4,467,799 | A | | 8/1984 | Steinberg | |
| 4,883,052 | A | | 11/1989 | Weiss et al. | |
| 5,033,479 | A | * | 7/1991 | Tanny | 128/849 |
| 5,143,752 | A | * | 9/1992 | Nakajima et al. | 427/244 |
| D368,960 | S | * | 4/1996 | Lanford | D24/110.1 |
| 5,538,013 | A | | 7/1996 | Brannon | |
| 5,699,792 | A | * | 12/1997 | Reese et al. | 128/206.19 |
| 5,706,803 | A | | 1/1998 | Bayer | |
| 5,706,804 | A | * | 1/1998 | Baumann et al. | 128/206.19 |
| 5,727,544 | A | | 3/1998 | Miura | |
| 5,803,077 | A | * | 9/1998 | Gazzara | 128/205.27 |
| 5,842,470 | A | | 12/1998 | Ruben | |
| 5,863,312 | A | | 1/1999 | Wolfe | |
| 5,934,275 | A | * | 8/1999 | Gazzara | 128/205.27 |

OTHER PUBLICATIONS

The Random House Webster's Unabridged Dictionary, 2001.*

Stedman's Medical Dictionary, 26th Ed. 1995.*

Stedmen's Medical Dictonary, 26th ed. pp. 48, 99–101 & 103–105.*

M. B. Hocking, Indoor Air Quality: Recomendations Relevant to Aircraft Passenger Cabins, AIHA Journal: vol. 59, No. 7, p. 446–454.

Web Page entitled, "Laser(TM) Surgical Masks", www2.allegiance.net/allegianceipc/docs/4/47128–020.asp-?ShowImages=Yes dated Mar. 30, 1999.

Advertisement from Medibed(TM) Dust Mite Barrier Bedding. pp. 1–4.

"A tale of three barriers: Urethane–Lined vs. Woven vs. Medibed", pp. 1–3.

* cited by examiner

*Primary Examiner*—John G. Weiss
*Assistant Examiner*—Joseph F. Weiss, Jr.
(74) *Attorney, Agent, or Firm*—Foley & Lardner; Bernard L. Kleinke

(57) ABSTRACT

A disposable travel mask has a body and is held in position over the nose and mouth of a wearer. The body of the ask has a filter area for entrapping air-borne contaminates. The filter area has at least two layers, such as an inner layer adjacent the wearer's mouth and an outer layer. The outer layer entraps large contaminates such as dust and also traps at least a portion of the bacteria or other germs. The other layer entraps contaminates that have passed through the first layer. The travel mask may be assembled from commonly available materials. For example, an anti-allergen filter material may be sealed to a surgical mask or a laser mask. The travel mask may have a printed design or pattern to make the travel mask more aesthetically pleasing and to allow the travel mask to better blend into a travel environment.

13 Claims, 2 Drawing Sheets

DISPOSABLE FILTERING FACE MASK AND METHOD OF MAKING SAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Technical Field

The field of the present invention is the manufacture and use of disposable filtering face masks.

2. Background Art

Airline travel is a common form of transportation with millions of passenger miles flown each year. However, in the confined seating area of an airplane cabin, passengers are likely to come in contact with bacteria or other germs carried by other passengers seated in close proximity. Some of the diseases that can be caused by inhalation of bacteria include pneumonia, Legionnaire's disease, diphtheria, meningitis, whooping cough, Q-fever, and tuberculosis. The inhalation of virus can cause the common cold, influenza, measles, mumps, chicken pox, shingles, and infectious mononucleosis. Further, since the air in the airplane cabin is commonly re-circulated, a passenger may be exposed to bacteria or other germs expelled by another passenger seated in a distant area of the cabin. For example, a passenger sitting at the rear of the aircraft cabin may sneeze, thereby introducing numerous bacteria and other germs into the surrounding air. Not only will these germs travel to nearby passengers, but the germs will be transported by the airplane's air recirculation system to other passengers throughout the cabin. In such a manner, germs emanating from a single person anywhere on the aircraft may be transported to expose the rest of the passengers to that person's germs.

It is thereby common for airplane passengers to be infected and fall ill after traveling on an airplane. Such illness is not only uncomfortable but can lead to lost work or even long-term health problems. Not only is exposure to germs a problem, but the recirculated air in an airplane cabin may carry other dangerous contaminants. For example, to improve the quality of air in the cabin, outside air may be introduced into the cabin. Thereby the cabin air may contain a component of fresh air. This outside air is cold and therefore must be warmed before entering the cabin. Typically this cold air is warmed using the plane's engine. In the process of being warmed the air may contact hydraulic fluids or lubricating oils before being expelled into the cabin. In such a manner the warmed air may contain dangerous hydrocarbon products. Exposure to such hydrocarbon products has also been linked with health problems.

Others have tried to protect humans from bacterial contact while in airplanes.

For example, U.S. Pat. No. 3,315,674 discloses a filter mask facelet so that crewmen can avoid contamination from other crewmen when using masks. However, such a device is large, bulky, and expensive, and therefore would not be practical for use by passengers in the cabin area of a modern airliner.

Other such complicated filtering masks include U.S. Pat. Nos. 3,747,599 and 4,141,703. Both patents disclose sophisticated mask systems for protecting the wearer. However, both are complicated and expensive devices which would not be practicable for implementation in an airline cabin. Further, all three masks described thus far would substantially interfere with passenger communication. Such interference would not only be an annoyance to the passenger, but could become critical in an emergency situation.

U.S. Pat. No. 5,863,312 discloses a non-entraining filter to be worn on the face. However, this mask is constructed of a specially constructed filtering membrane. For example, such a filtering material may be created by cutting holes with a laser or by etching the membrane using x-ray lithography. With such sophisticated manufacturing techniques, the mask of the '312 patent is a permanent mask not appropriate for use as a single-use, disposable mask.

U.S. Patent No. 5,707,803 discloses an easier to manufacture disposable face mask. The face mask of the '803 patent provides a disposable mask for use by healthcare professionals when there is a risk of exposure to tuberculosis. In particular the '803 patent discloses a sealing system that reduces the spread of contamination by providing improved resistance to leakage. Further, U.S. Pat. No. 5,842,470 discloses other surgical masks to be worn by healthcare professionals while administering healthcare functions.

With the increase in use of lasers in medical procedures, new protective masks have been developed to protect health care professionals. In particular, "laser masks" have been developed that filter the tiny airborne vaporized debris from laser surgery procedures.

Another problematic air-borne contaminate is caused by dust mites. Dust mites are microscopic organisms which live in pillows and headrests, for example. Dust mites thrive on the warmth and humidity provided by the human head and therefore thrive in these pillows and headrests. Over time dust mites produce waste which builds up in the pillows and headrests. Thereby, when a human's head compresses a pillow or headrest, the air expelled will contain quantities of airborne dust mite waste. This airborne dust mite waste contributes to asthma, sinusitis and other respiratory allergies. Indeed, mite waste is the number one cause of year-round hay fever symptoms. Traditional approaches to controlling dust mite waste have resulted in uncomfortable and unfamiliar coverings being placed on headrests and pillows. Therefore, there exists a need to protect air travelers from exposure to dust mite waste from pillows and headrests.

Therefore, there exists a need for a disposable mask which may be inexpensively manufactured from commonly available materials, but yet protects from the inhalation of air-borne contaminants.

SUMMARY OF THE INVENTION

It is therefore an object of the present invention to provide a disposable mask for protecting air travelers from airborne contaminants.

In a further separate aspect of the present invention it is desired the disposable travel mask be constructed of commonly available materials in a cost efficient manner.

Therefore, to meet the above objectives and overcome the disadvantages in the art, herein is a provided a novel disposal face mask. A disposable travel mask has a body and is held in position over the nose and mouth of a wearer. The body of the mask has a filter area for entrapping air-borne contaminates. The filter area has at least two layers, such as an inner layer adjacent the wearer's mouth and an outer layer. The outer layer entraps large contaminates such as dust and also traps at least a portion of the bacteria or other germs. The other layer entraps contaminates that have passed through the first layer. The travel mask may be assembled from commonly available materials. For example, an anti-allergen filter material may be sealed to a surgical mask or a laser mask. The travel mask may have a printed design or pattern to make the travel mask more aesthetically pleasing and to allow the travel mask to better blend into a travel environment.

Advantageously, the novel disposable face mask provides superior bacterial and contaminant protection for its wearer at a reasonable cost. Thereby, passengers boarding an aircraft may readily purchase a disposable travel mask and comfortably wear the disposable travel mask while in flight. At flight termination, the wearer simply disposes of the mask upon exiting the aircraft.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
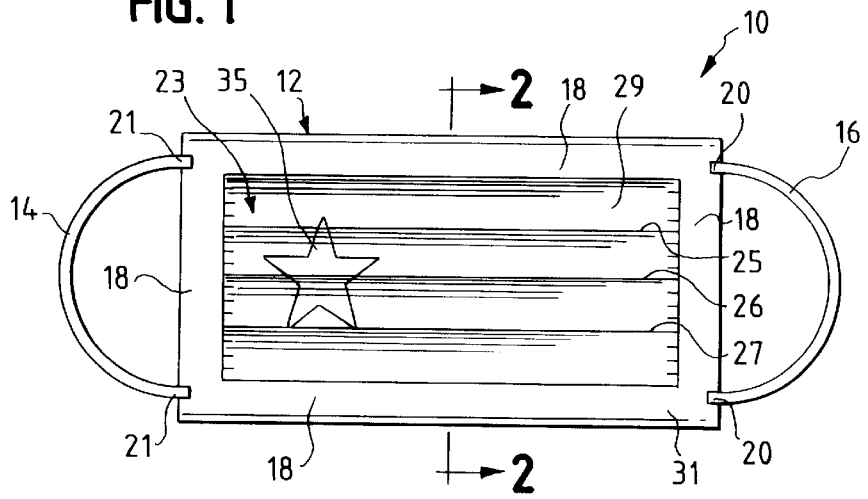
FIG. 1 is a diagrammatic front view of a travel mask made in accordance with the present invention.
Figure 2:
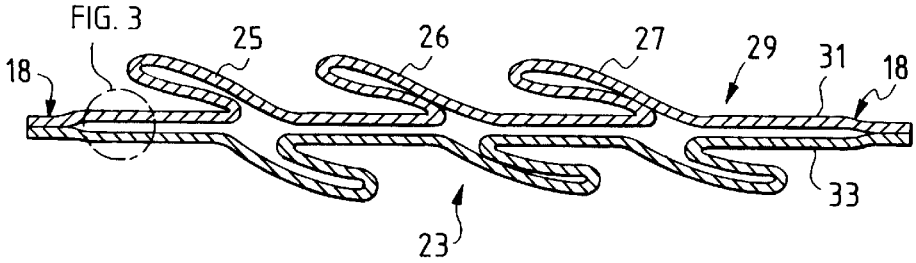
FIG. 2 is a diagrammatic, enlarged, cross sectional view taken at line A—A of FIG. 1.

Referring now to FIG. 1, a disposable travel mask 10 constructed in accordance with the present invention is shown. The travel mask 10 is for positioning on a wearer in a manner that air inhaled through the mouth or nose of the wearer must pass through a filter. The filter traps most airborne contaminants before those contaminants are inhaled by the wearer. The travel mask 10 is constructed in a manner for casual travel use by any passenger desiring to limit exposure to airborne contaminants. Since the travel mask is not designed or manufactured to stringent medical requirements, the disposal travel mask 10 provides an inexpensive way to avoid exposure to contaminants.

The travel mask 10 generally comprises a body 12 for positioning over the face and mouth of a wearer. The body 12 is held to the wearer's face and mouth by an attachment means. Attachment means in the form of ear loops 14 and 15 loop behind the wearer's ears to hold body 12 in position. The body 12 has a filter means for removing. contaminants from inhaled air. The filter means is a multi-ply filter 29 formed into a fan-fold shape. The multi-ply filter 29 has an outer membrane 31 for filtering out large particles and some bacteria or other germs, for providing structural integrity for the travel mask, and for providing a printable surface. The multi-ply filter 29 also has an inner membrane 33 for providing entrapment of other smaller airborne contaminants. For example, the outer membrane 31 may be an anti-allergen material for entrapping dust particles, bacteria, some viruses, or dust mite waste material.

The various components of the travel mask 10 will now be discussed in more detail. The travel mask 10 has a body 12 to which are attached ear loops 14 and 16. The body 12 is generally constructed of two oppositely opposed membranes. The inner membrane 33 may be constructed from paper, or other commonly available breathable material. This inner membrane 33 may be selected to entrap smaller types of contaminants that have passed through the outer membrane 31. For example, the outer membrane 31 may be selected to entrap airborne particles larger than 15 microns. In such a manner the outer membrane 31 would entrap dust particles or other such contaminants from inhaled air but allow the passage of smaller contaminants such as some bacteria or dust mite waste.

The inner membrane 33 is preferably the filter area for a surgical mask. Alternatively, the inner membrane 33 can comprise the filter area of a laser mask for entrapping smaller contaminants such as bacteria and other germs.

The outer membrane 31 be constructed of a material readily accepting offset or other printing. In such a manner, the outer manner 31 may contain an indicia 35.

Indicia 35 may be applied to make the travel mask 10 more aesthetically pleasing or to provide an advertising message. In such a manner the travel mask 10 may be more appropriately and comfortably worn in the casual atmosphere of an airline cabin. Indeed, the outer membrane 31 may even be printed in colors, designs, or patterns for adapting to the travel environment. Travel masks 10 may be provided in various color and designs for coordinating with a wearer's travel apparel. Thus, the wearer will be less embarrassed or self-conscious when wearing the mask and is thereby more likely to wear the mask. Further, indicia 35 may be applied in the form of an advertising message. Thereby, the manufacturer of travel mask 10 may sell advertising space on the travel mask 10, further reducing the cost of the travel mask to the airline traveler.

The outer membrane 31 has fan fold pleats 25, 26 and 27 for allowing the expandability of the breathable area 23. Those skilled in the art will recognize that the fan fold area may extend across the entire body 12 of the travel mask 10.

The body 12 also has an inner membrane 33. The inner membrane 33 is placed oppositely the outer membrane 31 and is positioned closer to the wearer's mouth and nose. The outer membrane 31 attaches to the inner membrane 33 at sealing area 18.

Depending on the material selected for membranes 31 and 33, different methods for sealing will be incorporated. For example, if both membranes 31 and 33 are of a composite material, then the membranes may be attached by pressure and heat at sealing area 18. However, if the outer membrane 31 is constructed of paper or cloth, then the sealing area 18 may incorporate stitching to attach the membranes together.

Figure 3:
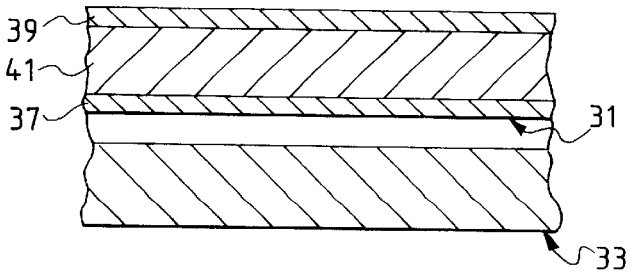
FIG. 3 is an enlarged cross sectional view at line B—B of FIG. 2.

Outer membrane 31 may itself be a multi-ply filtering membrane. For example, FIG. 3 shows the outer membrane 31 having three layers: layers 37 and 39 encase layer 41. The outer layers 37 and 39 are constructed of polyolefin while the inner layer 41 is a polyolefin maze. The polyolefin maze allows air to freely pass but entraps airborne contaminants. The polyolefin maze 41 provides effective entrapment of small particle contaminants. By entrapping such particulate, the polyolefin maze effectively blocks the inhalation of dust mite waste and other airborne contaminants. Those skilled in the art will recognize other filtering material may be substituted.

Ear loops 14 and 16 may be attached to the body 12, for example, by stitching 21 and 20. Those skilled in the art will readily recognize other attachment methods.

Figure 4:
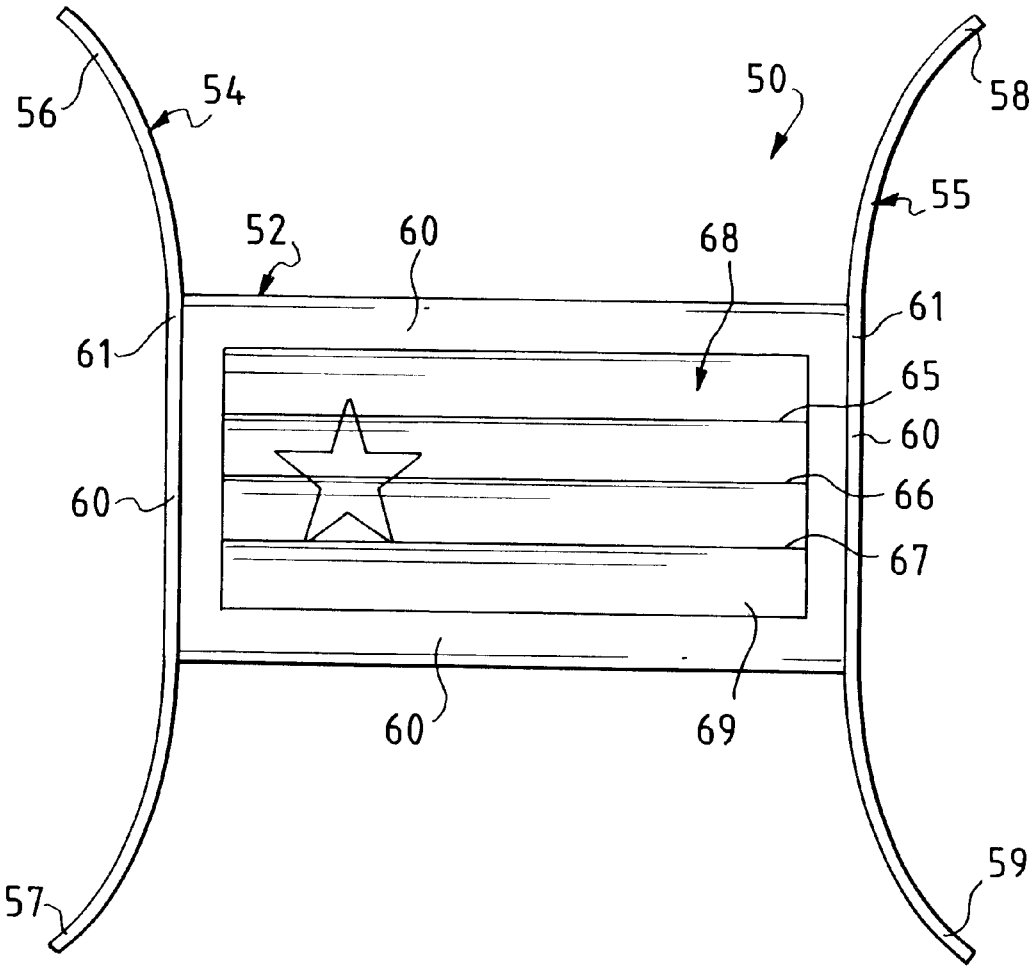
FIG. 4 is a diagrammatic front view of another travel mask made in accordance with the present invention.

FIG. 4 shows another travel mask 50 made in accordance with the present invention. Travel mask 50 has a body 52 which is like body 12 except body 52 uses tie straps 54 and 55 to position the body 52 at the wearer's mouth and nose. In such a manner, tie ends 57 and 59 are looped below the wearer's ears and a removable knot is formed. In a similar manner, tie ends 58 and 59 are routed above the wearer's ears and are tied. Thereby, the body 52 of the travel mask 50 is securely positioned over the wearer's mouth and nose. Like body 12, body 52 has a sealing are 60 and a breathable area 68. The multi-ply filter 69 has fan folds 65, 66 and 67. The tie straps 54 and 55 may be attached to the body 52 with stitching 61.

Since the travel mask does not need to be constructed to stringent medical requirements, the travel mask may be easily constructed from readily available materials.

For example, the inner membrane may be selected from paper, cloth, or a composite material, for example. Alternatively, the inner membrane can be constructed using material providing laser mask protection. The outer membrane may be readily purchased from filter material manufacturers. Thereby, components for the travel mask are readily and economically available.

The travel mask may be conveniently and inexpensively manufactured. For example, masks such as low-end surgical masks, are conveniently available. The filter area of theses masks provide the inner membrane for filtering contaminates that have passed through the outer membrane. The low-end surgical ask will provide effective entrapment of some airborne contaminants. However, such a low-end mask will not protect against all types of airborne contaminants. Therefore, the outer membrane of filtering material is selected. This outer membrane may be an anti-allergen fabric or other such filtering material. This second layer is constructed to cover the filtering area of the low-end surgical mask, and is attached thereto. Depending on the materials selected, the outer membrane may be stitched to the low-end surgical mask or attached with pressure and heat. Those skilled in the art will recognize other attachment methods.

The outer membrane may be printed using standard printing techniques such as off-set printing or silk screening. The printing may be done before or after the outer membrane has been attached to the mask. The printing may include colors, patterns, or design to make the travel mask less conspicuous when worn in the airplane cabin. Further, the outer membrane may be printed with an advertising message.

Alternatively, travel masks may be manufactured using conveniently available laser masks. The laser surgical ask provides effective entrapment of some smaller contaminants. Like above, the outer membrane of anti-allergen material is secured to the filter area of the mask. Thereby particles passing through the outer membrane may be entrapped by the filter area of the laser mask. The laser mask entraps smaller particles than the standard surgical mask. Thus, a travel mask constructed with the laser mask provides more effective contamination entrapment than a travel mask constructed with a general surgical mask.

In use, a wearer may purchase a travel mask at a convenient retail outlet, for example, at a gift shop of an airport. The wearer selects the travel mask based on size, and preferred color or design. For example, a wearer may choose a full sized travel mask in a color and pattern matching that day's apparel. The wearer may also be traveling with a small child and choose a travel mask appropriately sized for children. Upon being seated in the airplane cabin, the wearer positions the travel mask over their nose and mouth and secures the mask via the available attachment means. In a similar manner the child's face mask would be secured. With the travel mask in place, the travel mask's filter effectively entraps particles present in the inhaled air. Although the travel mask covers the nose and mouth of the wearers, the wearers may easily and conveniently converse while traveling. Further, they are able to conveniently and easily communicate with travel attendants for safety. Further, the masks are readily removable in the case of an emergency where the user must put on an emergency oxygen mask.

Upon reaching their destination and deplaning, the wearers simply remove the travel masks and dispose of them in a convenient trash receptacle. By wearing the travel mask, the travelers have reduced their exposure to airborne contaminants and thereby are less likely to become ill. Further, the travelers have reduced exposure to other air-borne contaminants.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A disposable travel mask for removing air-borne contaminates from air inhaled by a traveler, the contaminates including large contaminates such as dust and small contaminates such as bacteria, dust mite waste, and viruses, comprising:

a mask body having a filter area, the mask body adapted to be secured to a traveler with attachment means; and a filter on the mask body constructed to be positioned over a nose and mouth of the traveler, the filter for entrapping the air-borne contaminates in air inhaled by the traveler, the filter further including:

a first membrane for entrapping a first set of contaminants, said first set of contaminants being larger than a predetermined size, and at least a portion of a second set of contaminants, said second set of contaminants being smaller than the predetermined size, with same of said second set of contaminants passing through the first membrane;

a second membrane for entrapping at least some of the second set of contaminants that passed through the first membrane; and means for sealing the first membrane to the second membrane, wherein at least one of said first membrane and said second membrane comprises an anti-allergen filter for entrapping unwanted material;

said first membrane being fanfolded to form a series of generally equal-sized flaps each extending reversely folded completely from a front side of a first plane thereof and pointing in one direction;

said flaps being equally spaced apart and separated by intervals of a distance substantially equal to the length of each flap;

said second membrane being fanfolded to form a series of generally equal-sized flaps each extending reversely folded completely from a back side of a second plane and pointing in an opposite direction relative to the first-mentioned direction;

said first and second membranes being disposed in a back-to-back relationship with said first and second planes being disposed parallel to and in registration with one another;

said flaps of said first membrane being completely on a first side of a dividing plane;

said flaps of said second membrane being completely on a second side of the dividing plane;

each one of said flaps of said first membrane being disposed opposite and spaced apart from an adjacent flat interval;

corresponding flat intervals of said first and second membranes being disposed opposite and in aligned registration with one another; and corresponding pairs of first membrane flaps and second membrane flaps extending from opposite ends of correspondingly aligned first and second intervals.

2. The disposable travel mask according to claim 1 wherein the mask body is a body for a surgical mask.

3. The disposable travel mask according to claim 1 wherein the mask body is a body for a laser surgical mask.

4. The disposable travel mask according to claim 1 wherein indicia in the form of a patter, design, or advertising message is disposed on the first membrane, the indicia disposed in a manner that the indicia is visible to others while the mask is worn.

5. The disposable travel mask according to claim 1, wherein said unwanted material includes at least one of dust particles, bacteria, viruses and dust mite waste material.

6. A method of making a travel mask for a traveler, comprising:

providing a face mask, the face mask having attachment means to secure the face mask to the traveler, the face mask providing a filter area with a membrane for entrapping air-borne contaminates from air inhaled by the traveler;

selecting a filter material for entrapping air-borne contaminates, said filter material comprising an anti-allergen filter; and sealing the filter material to the filter area of the mask so that air inhaled by the traveler will pass through both the membrane and the filter material.;

said membrane having a first layer and a second layer;

said first layer being fanfolded to form a series of generally equal-sized flaps each extending reversely folded completely from a front side of a first plane thereof and pointing in one direction;

said flaps being equally spaced apart and separated by intervals of a distance substantially equal to the length of each flap;

said second layer being fanfolded to form a series of generally equal-sized flaps each extending reversely folded completely from a back side of a second plane and pointing in an opposite direction relative to the first-mentioned direction;

said first and second layers being disposed in a back-to-back relationship with said first and second planes being disposed parallel to and in registration with one another;

said flaps of said first layer being completely on a first side of a dividing plane;

said flaps of said second layer being completely on a second side of the dividing plane;

each one of said flaps of said first layer being disposed opposite and spaced apart from an adjacent flat interval;

corresponding flat intervals of said first and second layers being disposed opposite and in aligned registration with one another; and corresponding pairs of first layer flaps and second layer flaps extending from opposite ends of correspondingly aligned first and second intervals.

7. The method of making a travel mask for a traveler according to claim 6, wherein the face mask is a surgical mask.

8. The method of making a travel mask for a traveler according to claim 6, wherein the face mask is a laser surgical mask.

9. The method of making a travel mask according to claim 6, further comprising:

printing on an imprintable area of the filter material indicia configured in the shape of an aesthetically pleasing pattern or design.

10. A disposable travel mask for removing air-borne contaminates from air inhaled by a traveler, the contaminates including large contaminates such as dust and small contaminates such as bacteria, dust mite waste, and viruses, comprising:

a mask body having a filter area, the mask body adapted to be secured to a traveler with attachment means; and a filter on the mask body constructed to be positioned over a nose and mouth of the traveler, the filter for entrapping the air-borne contaminates in air inhaled by the traveler, the filter further including:

a first membrane for entrapping larger contaminants, said larger contaminants being larger than a predetermined size, and at least a portion of the smaller contaminants, said smaller contaminants being smaller than the predetermined size, with some of said smaller contaminants passing through the first membrane;

a second membrane for entrapping at least some of the small contaminants that passed through the first membrane; and means for sealing the first membrane to the second membrane, said first membrane being fanfolded to form a series of generally equal-sized flaps each extending reversely folded completely from a front side of a first plane thereof and pointing in one direction;

said flaps being equally spaced apart and separated by intervals of a distance substantially equal to the length of each flap;

said second membrane being fanfolded to form a series of generally equal-sized flaps each extending reversely folded completely from a back side of a second plane and pointing in an opposite direction relative to the first-mentioned direction;

said first and second membranes being disposed in a back-to-back relationship with said first and second planes being disposed parallel to and in registration with one another;

said flaps of said first membrane being completely on a first side of a dividing plane;

said flaps of said second membrane being completely on a second side of the dividing plane;

each one of said flaps of said first membrane being disposed opposite and spaced apart from an adjacent flat interval;

corresponding flat intervals of said first and second membranes being disposed opposite and in aligned registration with one another; and corresponding pairs of first membrane flaps and second membrane flaps extending from opposite ends of correspondingly aligned first and second intervals.

11. A filter for a disposable travel mask for removing air-borne contaminates from air inhaled by a traveler, comprising:

a first membrane for entrapping contaminants; and a second membrane being sealed to said first membrane;

said first membrane being fanfolded to form a series of generally equal-sized flaps each extending reversely folded completely from a front side of a first plane thereof and pointing in one direction;

said flaps being equally spaced apart and separated by intervals of a distance substantially equal to the length of each flap;

said second membrane being fanfolded to form a series of generally equal-sized flaps each extending reversely folded completely from a back side of a second plane and pointing in an opposite direction relative to the first-mentioned direction;

said first and second membranes being disposed in a back-to-back relationship with said first and second planes being disposed parallel to and in registration with one another;

said flaps of said first membrane being completely on a first side of a dividing plane;

said flaps of said second membrane being completely on a second side of the dividing plane;

each one of said flaps of said first membrane being disposed opposite and spaced apart from an adjacent flat interval;

corresponding flat intervals of said first and second membranes being disposed opposite and in aligned registration with one another; and corresponding pairs of first membrane flaps and second membrane flaps extending from opposite ends of correspondingly aligned first and second intervals.

12. A method of making a travel mask for a traveler, comprising:

providing a face mask, the face mask having attachment means to secure the face mask to the traveler, the face mask providing a filter area with a membrane for entrapping air-borne contaminates from air inhaled by the traveler;

selecting a filter material capable of entrapping air-borne contaminates; and sealing the filter material to the filter area of the mask so that air inhaled by the traveler will pass through both the membrane and the, filter material, said membrane being fanfolded to form a series of generally equal-sized flaps each extending reversely folded completely from a front side of a first plane thereof and pointing in one direction;

said flaps being equally spaced apart and separated by intervals of a distance substantially equal to the length of each flap;

said filter material being fanfolded to form a series of generally equal-sized flaps each extending reversely folded completely from a back side of a second plane and pointing in an opposite direction relative to the first-mentioned direction;

said membrane and said filter material being disposed in a back-to-back relationship with said first and second planes being disposed parallel to and in registration with one another;

said flaps of said membrane being completely on a first side of a dividing plane;

13. The method of making a travel mask according to claim 2, further comprising printing on an imprintable area of the filter material indicia configured in the shape of an aesthetically pleasing pattern or design.

* * * * *

UNITED STATES PATENT AND TRADEMARK OFFICE

CERTIFICATE OF CORRECTION

PATENT NO. : 6,412,486 B1
DATED : July 2, 2002
INVENTOR(S) : Leonard W. Glass

It is certified that error appears in the above-identified patent and that said Letters Patent is hereby corrected as shown below:

Column 6,
Line 40, change "same" to -- some --

Column 7,
Line 36, delete the "period" after the word material

Column 10,
Line 28, insert all of the following after line 28:

-- said flaps of said filter material being completely on a second side of the dividing plane;

each one of said flaps of said membrane being disposed opposite and spaced apart from an adjacent flat interval;

corresponding flat intervals of said membrane and of said filter material being disposed opposite and in aligned registration with one another; and corresponding pairs of membrane flaps and filter material flaps extending from opposite ends of correspondingly aligned first and second intervals. --

Signed and Sealed this

Fifth Day of November, 2002

*Attest:*

*Attesting Officer*

JAMES E. ROGAN
*Director of the United States Patent and Trademark Office*